US012565997B2

(12) United States Patent
Noritake

(10) Patent No.: US 12,565,997 B2
(45) Date of Patent: Mar. 3, 2026

(54) PREMIXING APPARATUS

(71) Applicant: RINNAI CORPORATION, Aichi (JP)

(72) Inventor: Katsuya Noritake, Aichi (JP)

(73) Assignee: Rinnai Corporation, Aichi (JP)

( * ) Notice: Subject to any disclaimer, the term of this patent is extended or adjusted under 35 U.S.C. 154(b) by 743 days.

(21) Appl. No.: 17/940,608

(22) Filed: Sep. 8, 2022

(65) Prior Publication Data

US 2023/0112151 A1 Apr. 13, 2023

(30) Foreign Application Priority Data

Oct. 12, 2021 (JP) ..... 2021-167404

(51) Int. Cl.

| | |
|---|---|
| ***F23R 3/28*** | (2006.01) |
| ***F23D 14/02*** | (2006.01) |
| ***F23N 1/06*** | (2006.01) |
| ***F23R 3/26*** | (2006.01) |

(52) U.S. Cl.

CPC ..... *F23R 3/286* (2013.01); *F23D 14/02* (2013.01); *F23N 1/065* (2013.01); *F23R 3/26* (2013.01); *F23N 2225/16* (2020.01); *F23N 2229/12* (2020.01); *F23N 2235/06* (2020.01)

(58) Field of Classification Search

CPC .. F23R 3/286; F23R 3/26; F23D 14/02; F23N 1/065; F23N 2225/16; F23N 2229/12; F23N 2235/06; F23N 1/022

See application file for complete search history.

(56) References Cited

U.S. PATENT DOCUMENTS

| | | | | |
|---|---|---|---|---|
| 10,030,868 | B2 * | 7/2018 | Nakatani | F23D 14/62 |
| 10,317,076 | B2 * | 6/2019 | Super | F23N 1/027 |
| 10,330,312 | B2 * | 6/2019 | Shimazu | F23N 1/02 |
| 10,495,301 | B2 * | 12/2019 | Nonoyama | F23D 14/02 |
| 10,655,848 | B2 * | 5/2020 | Sei | F23C 5/08 |
| 12,055,292 | B2 * | 8/2024 | Noritake | F23N 1/02 |
| 2005/0274328 | A1 * | 12/2005 | Baese | F24H 9/20 |
| 2017/0284663 | A1 * | 10/2017 | Nonoyama | F23D 14/06 |
| 2021/0041100 | A1 * | 2/2021 | Noritake | F23D 14/02 |

FOREIGN PATENT DOCUMENTS

JP 2021-025722 A 2/2021

* cited by examiner

*Primary Examiner* — Vivek K Shirsat

(74) *Attorney, Agent, or Firm* — Future IP LLC; Tomoko Nakajima

(57) ABSTRACT

A premixing apparatus that mixes a fuel gas with air and supplies an air-fuel mixture in a burner through a fan includes a control device that is configured to carry out a third control that: calculates and memorizes a lower limit of a rotational speed of a fan, at which an increase of an opening degree of a variable throttle valve becomes necessary, as a first threshold; and when the rotational speed of the fan increases to the first threshold or faster next time, immediately changes the opening degree of the variable throttle valve to an increased opening degree, which is larger than a predetermined standard opening degree and is obtained by multiplying a deviation of the rotational speed of the fan from the first threshold by a predetermined coefficient.

2 Claims, 3 Drawing Sheets

PREMIXING APPARATUS

TECHNICAL FIELD

The invention relates to a premixing apparatus that mixes a fuel gas with air and supplies an air-fuel mixture to a burner through a fan.

BACKGROUND ART

There has been conventionally known one of the above-identified premixing apparatuses, with which a fan, an air supply passage that is on an upstream side of the fan, a gas supply passage of which a downstream side end is connected to a gas suction part that is disposed in the air supply passage, and a zero governor that regulates a secondary gas pressure to an atmospheric pressure and is interposed in the gas supply passage are provided. A supply amount of the fuel gas varies with a differential pressure between the atmospheric pressure, i.e., the secondary gas pressure, and a negative pressure in the air supply passage. Since the negative pressure in the air supply passage varies with a rotational speed of the fan, the supply amount of the fuel gas varies in proportion to the rotational speed of the fan, in other words, a supply amount of air. Accordingly, by controlling the rotational speed of the fan depending on a required combustion amount, the air-fuel mixture in an amount corresponding to the required combustion amount is supplied to the burner and an excess air ratio of the air-fuel mixture (an amount of a primary air/an amount of air with a theoretical air fuel ratio) becomes constant.

Provided that a same kind of a gas is being used as the fuel gas, it happens that a calorific value of the fuel gas (Wobbe Index) fluctuates with time. In the above-mentioned premixing apparatus, even if the calorific value of the fuel gas fluctuates, a ratio of the supply amount of the fuel gas to the supply amount of air remains constant. Therefore, the excess air ratio of the air-fuel mixture fluctuates due to fluctuation of the calorific value of the fuel gas, resulting in poor combustion.

To suppress the poor combustion, there has been also known, in patent document 1, a premixing apparatus with which a variable throttle valve that is interposed in a portion of the gas supply passage, which is on a downstream side of the zero governor, an excess air ratio detecting device that detects the excess air ratio of the air-fuel mixture, and a control device are provided. By the control device, regulation of an opening degree of the variable throttle valve can be carried out so that the excess air ratio of the air-fuel mixture, which is detected by the excess air ratio detecting device, becomes a predetermined appropriate value. According to such the premixing apparatus as above-mentioned, even if the calorific value of the fuel gas fluctuates, the excess air ratio of the air-fuel mixture is maintained the appropriate value by the regulation of the opening degree of the variable throttle valve and therefore occurrence of poor combustion can be suppressed.

Further, in the premixing apparatus that is disclosed in patent document 1, a butterfly valve is interposed in a portion of the air supply passage, which is on an upstream side of the gas suction part and the control device carries out switching of a combustion capacity by changing opening degrees of the butterfly valve and the variable throttle valve between at least two stages of a large-capacity stage and a small-capacity stage. That is, in a case where the required combustion amount is relatively small, the opening degree of the butterfly valve is changed to a predetermined closing-side small-capacity opening degree and the opening degree of the variable throttle valve is changed to a predetermined small-capacity opening degree, which is relatively small. The combustion capacity is thus switched to the small-capacity so that the air-fuel mixture with the appropriate value of the excess air ratio and in an amount corresponding to a relatively-small required combustion amount can be supplied to the burner. Also, in a case where the required combustion amount is relatively large, the opening degree of the butterfly valve is changed to a predetermined opening-side large-capacity opening degree and the opening degree of the variable throttle valve is changed to a predetermined large-capacity opening degree, which is relatively large. The combustion capacity is thus switched to the large-capacity so that the air-fuel mixture so that the air-fuel mixture with the appropriate value of the excess air ratio and in an amount corresponding to a relatively-large required combustion amount can be supplied to the burner.

Incidentally, in a case where a primary gas pressure is reduced due to a state of gas piping and something else, when the rotational speed of the fan increases depending on the required combustion amount, the supply amount of the fuel gas is less than the one which corresponds to the rotational speed of the fan and therefore the excess air ratio of the air-fuel mixture increases beyond the appropriate value. In this case, in the premixing apparatus that is disclosed in patent document 1, a control (a feedback control) that increases the opening degree of the variable throttle valve is carried out. As a result, the supply amount of the fuel gas increases and the excess air ratio of the air-fuel mixture is restored to the appropriate value.

However, it takes time for such the feedback control to restore the excess air ratio of the air-fuel mixture to the appropriate value by change of the opening degree of the variable throttle valve. Additionally, there are some fears of temporary occurrence of poor combustion while restoring the excess air ratio to the appropriate value.

REFERENCE

Patent Document 1: JP2021-025722 A

SUMMARY OF INVENTION

Technical Problems

In the light of the above-mentioned problems, the invention provides a premixing apparatus which can suppress the temporary occurrence of the poor combustion in the case where the primary gas pressure is reduced.

Solution to Problems

In order to solve the above-mentioned problems, the invention presupposes a premixing apparatus that mixes a fuel gas with air and supplies an air-fuel mixture to a burner through a fan, and includes: the fan; an air supply passage on an upstream side of the fan; a gas supply passage of which a downstream side end is connected to a gas suction part that is disposed in the air supply passage; a zero governor that is interposed in the gas supply passage, the zero governor regulating a secondary gas pressure to an atmospheric pressure; a variable throttle valve that is interposed in a portion, on an upstream side of the zero governor, of the gas supply passage; an excess air ratio detecting device that detects an excess air ratio of the air-fuel mixture; and a control device that is configured to carry out a first control that varies a rotational speed of the fan depending on a required combustion amount and a second control that regulates an opening degree of the variable throttle valve so that the excess air ratio of the air-fuel ratio, which is detected by the excess air ratio detecting device, becomes a predetermined appropriate value. In the invention, the control device is also configured to carry out a third control that: when the rotational speed of the fan is increased depending on the required combustion amount and in a case where the excess air ratio of the air-fuel mixture that is detected by the excess air ratio detecting device increases beyond the appropriate value and the opening degree of the variable throttle valve is controlled to increase beyond a predetermined standard opening degree so that the excess air ratio becomes the appropriate value, calculates and memorizes a lower limit of the rotational speed of the fan, at which an increase of the opening degree of the variable throttle valve becomes necessary, as a first threshold; and when the rotational speed of the fan increases to the first threshold or faster next time, immediately changes the opening degree of the variable throttle valve to an increased opening degree, which is larger than the predetermined standard opening degree and is obtained by multiplying a deviation of the rotational speed of the fan from the first threshold by a predetermined coefficient.

According to the invention, due to reduction of a primary gas pressure, when the rotational speed of the fan increases to the first threshold or faster and in a case where the excess air ratio of the air-fuel mixture increases beyond the appropriate value, after the calculation and memorization of the first threshold value, when the rotational speed of the fan increases to the first threshold or faster, by the third control, the excess air ratio of the air-fuel mixture can be immediately restored to the appropriate value. Accordingly, occurrence of temporary poor-combustion can be suppressed in the case of reduction of the primary pressure.

Additionally, in the invention, as is similar to the latter conventional premixing apparatus, in a case where a butterfly valve is interposed in a portion, which is on an upstream side of the gas suction part, of the air supply passage, it is desirable that the control device is further configured to carry out a fourth control that: when the rotational speed of the fan depending on the required combustion amount is increased beyond a second threshold faster than the first threshold and in a case where the excess air ratio of the air-fuel mixture, which is detected by the excess air ratio detecting device, increases beyond the appropriate value and even by increasing the opening degree of the variable throttle valve to a maximum opening degree, the excess air ratio does not become the appropriate value, reduces an opening degree of the butterfly valve to a reduced opening degree at which the excess air ratio becomes the appropriate value; memorizes the reduced opening degree; increases the rotational speed of the fan faster than a standard rotational-speed corresponding to the required combustion amount until the combustion amount of the burner reaches the required combustion amount in a state where the opening degree of the variable throttle valve is a maximum opening degree; memorizes an increase amount at this time of the rotational speed of the fan from the standard rotational-speed as a rotational-speed correction value; when the rotational speed of the fan is increased beyond the second threshold next time, immediately not only changes the opening degree of the variable throttle valve to the maximum opening degree but also changes the opening degree of the butterfly valve to the reduced opening degree; and increases the rotational speed of the fan according to the rotational-speed correction value.

According to the above-mentioned premixing apparatus, when the rotational speed of the fan is increased beyond the second threshold due to the reduction of the primary gas pressure, in the case where, even by increasing the opening degree of the variable throttle valve to the maximum opening degree, the excess air ratio of the air-fuel mixture does not become the appropriate value, by the fourth control, after the reduced opening degree of the butterfly valve and the rotational-speed correction value are memorized, when the rotational speed of the fan increases beyond the second threshold next time, immediately not only the excess air ratio of the air-fuel mixture can be restored to the appropriate value but also the combustion amount of the burner can be made to the required combustion amount. Accordingly, occurrence of temporary poor-combustion and short combustion-amount within a fast rotational-speed of the fan can be suppressed in the case of the reduction of the primary gas pressure.

DESCRIPTION OF EMBODIMENTS

Figure 1:
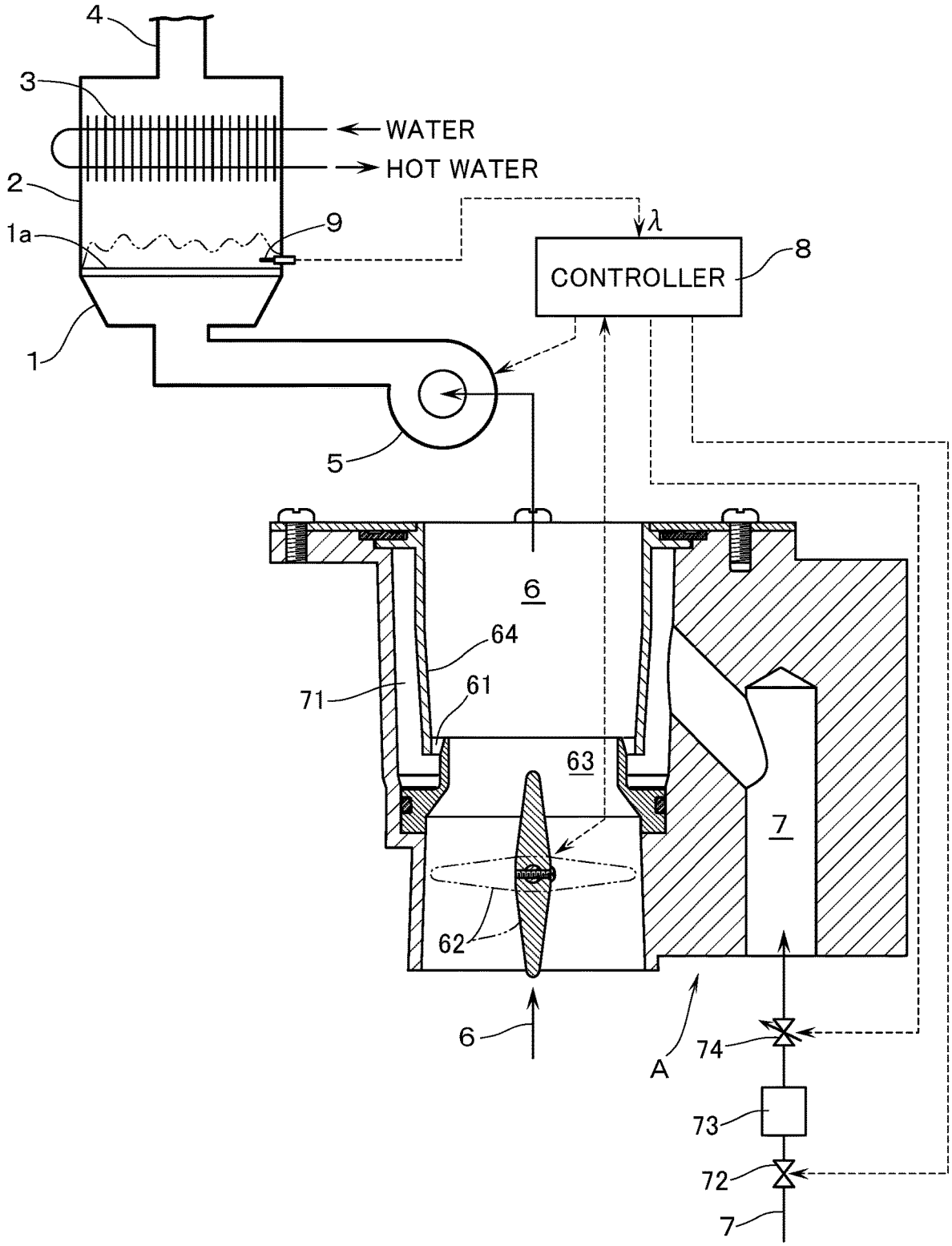
FIG. 1 shows an explanation diagram showing a premixing apparatus according to an embodiment of the invention.

A combustion apparatus that is shown in FIG. 1 is a heat source apparatus that includes a totally aerated combustion burner 1, a combustion box 2 enclosing a combustion space of an air-fuel mixture that ejects from a combustion surface 1*a* of the burner 1, and a heat exchanger 3 that is disposed in the combustion box 2. A combustion gas that is generated by combustion of the air-fuel mixture heats the heat exchanger 3 and is subsequently exhausted outside through an exhaust tube 4 that is connected to an end portion of the combustion box 2. By means of a premixing apparatus A of an embodiment according to the invention, a fuel gas is mixed with air and an air-fuel mixture is supplied to the burner 1 through a fan 5.

The premixing apparatus A includes the fan 5, an air supply passage 6 on an upstream side of the fan 5, and a gas supply passage 7 that supplies the fuel gas. A downstream side end of the fuel gas passage 7 is connected to a gas suction part 61 that is disposed in the air supply passage 6. In a portion adjacent to an upstream side of the gas suction part 61, a venturi part 63 with a diameter smaller than that of a portion of the air supply passage 6, in which a below-mentioned butterfly valve 62 is arranged, is disposed. A portion of the air supply passage 6, which is adjacent to a downstream side of the venturi part 63, is enclosed by a tubular part 64 with a diameter larger than that of the venturi part 63. A downstream side end portion of the venturi part 63 is inserted into an upstream-side end portion of the tubular part 64 while leaving an annular clearance and the annular clearance constitutes the gas suction part 61. A gas chamber 71 that communicates with the gas suction part 61 in a manner to enclose the tubular part 64 is provided at a downstream side end of the gas supply passage 7.

A main valve 72, a zero governor 73 that regulates a secondary gas pressure to an atmospheric pressure, and a variable throttle valve 74 are, from an upstream side downward in sequence, interposed in the gas supply passage 7. The premixing apparatus A also includes a controller 8 consisting of a microcomputer as a control device that controls the fan 5, the main valve 72, the variable throttle valve 74 and the butterfly valve 62.

An amount of the fuel gas that is supplied through the gas suction part 61 varies with a differential pressure between the atmospheric pressure which is the secondary gas pressure and a negative pressure in the air supply passage 6. It is to be noted here that the negative pressure in the air supply passage 6 varies with a rotational speed Nf of the fan 5. Therefore, the supply amount of the fuel gas varies in proportion to the rotational speed Nf of the fan 5, i.e., a supply amount of air. Further, a ratio of the supply amount of the fuel gas to the supply amount of the air also varies with an opening degree Gθ of the variable throttle valve 74. By changing the opening degree Gθ of the variable throttle valve 74 to a predetermined standard opening degree according to a kind of a gas to be used, an excess air ratio λ of the air-fuel mixture becomes a predetermined appropriate value Yλ (e.g., 1.3). Then, by controlling the rotational speed Nf of the fan 5 according to the required combustion amount Qd (a combustion amount required to deliver hot water at a set hot-water temperature), the air-fuel mixture with the appropriate value Yλ of the excess air ratio and in an amount corresponding to the required combustion amount Qd can be supplied to the burner 1.

On the other hand, in order to suppress poor exhaustion due to entry of a wind into the exhaust tube 4, i.e., in order to secure wind resistance performance, a lower-limit rotational speed of the fan 5 is unable to be set to be a considerably lower value. In a case where the required combustion amount Qd decreases to a predetermined value, which corresponds to the lower-limit rotational speed of the fan 5 or slower, it is impossible to supply the air in an amount corresponding to the required combustion amount Qd.

In the light of the above-mentioned inconvenience, in a portion of the air supply passage 6, which is on the upstream side of the gas suction part 61, in order to switch ventilation resistance at the portion in question between two stages of which one is large and the other is small, the butterfly valve 62 that can be switched by a motor not shown in any of drawings between an opened posture as illustrated in a solid line and a closed posture as illustrated in an imaginary line in FIG. 1 In a case where the required combustion amount Qd degreases to the above-mentioned predetermined value or smaller, the butterfly valve 62 is switched to the closed posture in order to increase the ventilation resistance of the air supply passage 6. The switching of the butterfly valve 62 to the closed posture can supply the air of which the amount corresponds to the combustion amount of the predetermined value or lower without changing the rotational speed Nf of the fan 5 to a lower-limit rotational speed or slower. Provided that only the ventilation resistance of the air supply passage 6 is increased by the closed posture of the butterfly valve 62, since the negative pressure in the air supply passage 6 increases and the supply amount of the fuel gas becomes excessive, the excess air ratio λ of the air-fuel mixture supplied to the burner 1 is fallen below the appropriate value Yλ. Therefore, in a case where the required combustion amount Qd is relatively small, a combustion capacity is switched to a small-combustion capacity in which not only the butterfly valve 62 is switched to the closed posture but also the opening degree Gθ of the variable throttle valve 74 is changed to such a predetermined small-capacity standard opening degree, which is relatively small, that the excess air ratio becomes the appropriate value at the closed posture of the butterfly valve 62. Accordingly, the air-fuel mixture with the appropriate value Yλ of the excess air ratio and in an amount corresponding to a relatively-small combustion amount can be supplied to the burner 1. On the other hand, in a case where the required combustion amount Qd is relatively large, the combustion capacity is switched to a large-combustion capacity in which not only the butterfly valve 62 is switched to the opened posture but also the opening degree Gθ of the variable throttle valve 74 is changed to such a predetermined large-capacity standard opening degree, which is relatively large, that the excess air ratio becomes the appropriate value at the opened posture of the butterfly valve 62. Accordingly, the air-fuel mixture with the appropriate value Yλ of the excess air ratio and in an amount corresponding to a relatively-large combustion amount can be supplied to the burner 1. As a result, a relationship between the rotational speed Nf of the fan 5 and the supply amount of the air-fuel mixture, namely, the combustion amount Q of the burner 1 will be shown by a characteristic line L in FIG. 2 in the small-capacity state and will be shown by a characteristic line H in FIG. 2 in the high-capacity state.

Incidentally, provided that a same kind of a gas is being used as the fuel gas, it happens that the calorific value of the fuel gas (Wobbe Index) fluctuates with time. In this case, if the ratio of the supply amount of the fuel gas to the supply amount of air is kept constant, the excess air ratio λ of the air-fuel mixture will fluctuate due to fluctuation of the calorific value of the fuel gas, resulting in poor combustion.

In order to suppress the poor combustion, an excess air ratio detecting device 9 that detects the excess air ratio λ of the air-fuel mixture is arranged. In the embodiment, the excess air ratio detecting device 9 is constituted by a flame rod provided in a manner to face the combustion surface 1*a* of the burner 1 and detects the excess air ratio λ based on a flame current that flows in the flame rod. On the other hand, since a flame gets close to or goes away from the combustion surface 1*a* depending on the excess air ratio λ of the air-fuel mixture, a rear-surface temperature of the combustion surface 1*a* varies with the excess air ratio λ of the air-fuel mixture. Accordingly, the excess air ratio detecting device 9 is possible to be constituted by a temperature sensor that senses the rear-surface temperature of the combustion surface 1*a*.

The excess air ratio λ of the air-fuel mixture that is detected by the excess air ratio detecting device 9 is input into the controller 8. The controller 8 carries out a feedback control of the variable throttle valve 74 so that the excess air ratio λ can be kept constant, in other words, the predetermined appropriate value Yλ can be maintained. Specifically, when the excess air ratio λ decreases with an increase of the calorific value of the fuel gas, the opening degree Gθ of the variable throttle valve 74 is reduced below the standard opening degree (in the small-capacity state, a small-capacity standard opening degree, and in the large-capacity state, a large-capacity standard opening degree) so that the ratio of the supply amount of the fuel gas to the supply amount of the air degreases to make the excess air ratio λ the appropriate value Yλ. On the other hand, when the excess air ratio λ of the air-fuel mixture increases with a decrease of the calorific value of the fuel gas, the opening degree Gθ of the variable throttle valve 74 is increased beyond the standard opening degree so that the ratio of the supply amount of the fuel gas to the supply amount of the air is increased to make the excess air ratio λ the appropriate value Yλ. Even if the calorific value of the fuel gas fluctuates, the excess air ratio λ of the fuel-gas mixture is thus maintained the appropriate value Yλ and the poor combustion can be suppressed.

Further, in a case where a primary gas pressure is reduced due to an arrangement state of gas piping and something else, when the rotational speed Nf of the fan 5 increases depending on the required combustion amount Qd in the high-capacity state, the supply amount of the fuel gas becomes less than an amount corresponding to the rotational speed Nf of the fan 5 and therefore the excess air ratio λ of the air-fuel mixture increases beyond the appropriate value Yλ. In this case, the opening degree Gθ of the variable valve 74 is increased beyond the high-capacity standard opening degree Gθn by the feedback control, the supply amount of the fuel gas increases, and the excess air ratio λ of the air-fuel mixture is restored to the appropriate value Yλ. However, it takes time for such the feedback control of the variable throttle valve 74 to restore the excess air ratio λ of the air-fuel mixture to the appropriate value Yλ. In the interim, there are some fears of the temporary occurrence of poor combustion.

Figure 3:
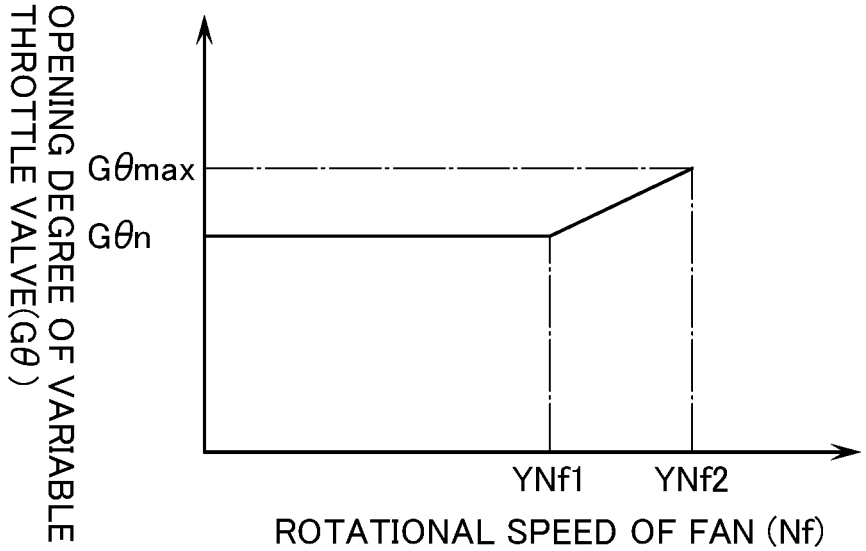
FIG. 3 is a graph showing between the rotational speed of the fan and an opening degree of a variable throttle valve in a case of reduction of a primary gas pressure in the premixing apparatus of the embodiment.

Here, in a case where the primary gas pressure is reduced, a relationship in the large-capacity state between the rotational speed Nf of the fan 5 and the opening degree Gθ of the variable throttle valve 74 when the excess air ratio λ of the air-fuel mixture becomes the appropriate value Yλ is as shown in FIG. 3. That is, until the rotational speed Nf of the fan 5 reaches a predetermined first threshold YNf1 or faster, the supply amount of the fuel gas is left an amount corresponding to the rotational speed Nf of the fan 5 and the opening degree Gθ of the variable throttle valve 74 is maintained at the large-capacity standard opening degree Gθn. When the rotational speed Nf of the fan 5 reaches the first threshold YNf1 or faster, the supply amount of the fuel gas decreases less than the amount corresponding to the rotational speed Nf of the fan 5 and the opening degree Gθ of the variable throttle valve 74 increases from the large-capacity standard degree Gθn along a predetermined oblique line due to an increase of the rotational speed Nf of the fan 5. In other word, in a region of Nf≥YNf1, the following equation, $$G\theta = G\theta n + K(Nf - YNf1) \quad (1)$$

is completed. In the equation (1), a coefficient K is an eigenvalue every model of the premixing apparatus and can be experimentally obtained.

Additionally, in a case where the opening degree Gθ of the variable throttle valve 74 is increased according to the equation (1), when the rotational speed Nf of the fan 5 reaches a predetermined second threshold YNf2 larger than the first threshold YNf1, the opening degree Gθ of the variable throttle valve 74 reaches a maximum opening degree Gθ max. Further, in a case where the rotational speed Nf of the fan 5 increases to the second threshold YNf2 or faster due to an increase of the required combustion amount Qd, the excess air ratio λ increases beyond the appropriate value Yλ due to a short supply amount of the fuel gas. In the latter case, by decreasing the opening degree Aθ of the butterfly valve 62 from a full opening degree that is the opening degree at the opened posture of the butterfly valve 62, the supply amount of the air decreases and the excess air ratio λ can be restored to the appropriate value Yλ. On the other hand, staying like this, the combustion amount Q of the burner 1 does not reach the required combustion amount Qd due to the short supply amount of the fuel gas. However, by increasing the rotational speed Nf of the fan 5 faster than a standard rotational-speed Nfn corresponding to the required combustion amount Qd (a speed conforming the characteristic line H shown in FIG. 2), the combustion amount Q of the burner 1 can be increased to the required combustion amount Qd.

Figure 4:
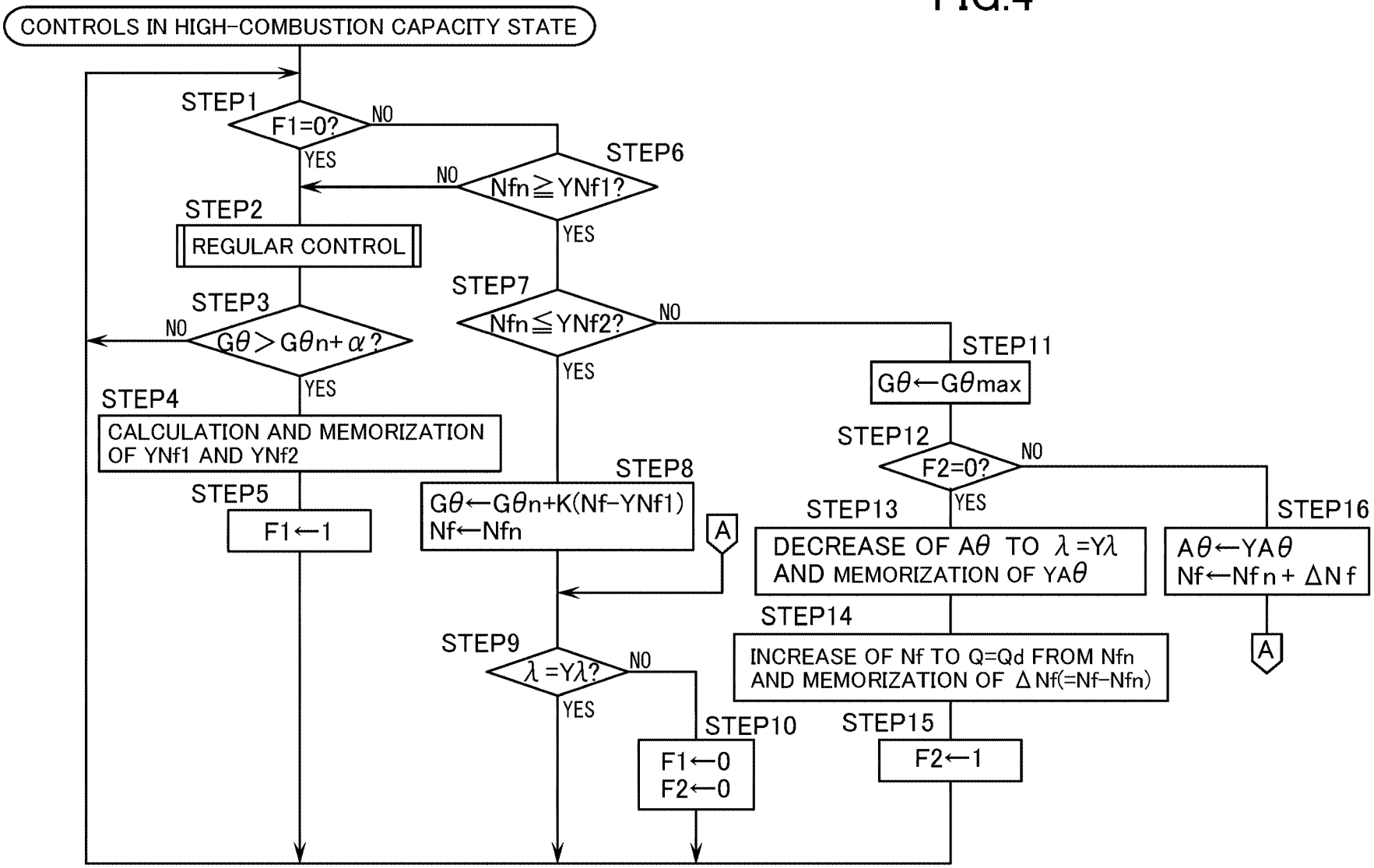
FIG. 4 is a flow diagram showing contents of controls carried out by a control device in a high-capacity state of the premixing apparatus of the embodiment.

Under consideration of the above-mentioned matters, in the embodiment, controls as shown in FIG. 4, which are carried out by the controller 8, are employed in the high-capacity state. Now, the controls are explained as follows: When switched to the high-capacity state, first, distinction whether a first flag F1 is reset to "0" is carried out in STEP 1. The first flag F1 is reset to "0" in an initial state. Therefore, the controls proceed from STEP 1 to STEP 2, a regular control is carried out. In the regular control, the rotational speed Nf of the fan 5 is made to the standard rotational-speed Nfn corresponding to the required combustion amount Qd and, in addition, the opening degree Gθ of the variable valve 74 is regulated so that the excess air ratio λ of the air-fuel mixture, which is detected by the excess air ratio detecting device 9, becomes the appropriate value Yλ.

Subsequently, the controls proceed to STEP 3. Distinction whether the opening degree Gθ of the variable throttle valve 74 is larger than an opening degree that is obtained by adding an upper limit α of a regulation range due to the calorific-value change of the fuel gas to the high-capacity opening degree Gθn is carried out. A case of Gθ>Gθn+α is the one where, when the rotational speed Nf of the fan 5 is increased depending on the required combustion amount Qd, due to reduction of the primary gas pressure, the supply amount of the fuel gas is less than the amount corresponding to the rotational speed Nf of the fan 5 and the excess air ratio λ of the air-fuel mixture increases beyond the appropriate value Yλ, Then, in a case of Gθ>Gθ+α, the controls proceed to STEP 4, the first threshold YNf1 that is a lower limit of a range of the rotational speed Nf of the fan 5 at which an increase of the opening degree Gθ of the variable valve 74 is necessitated is calculated using a following equation (2) derived from the equation (1) and is memorized.

$$YNf1 = Nf - (G\theta - G\theta n)/K \quad (2)$$

Besides, the second threshold YNf2 is calculated using a following equation (3) and is memorized.

$$YNf2 = YNf1 + (G\theta\ max - G\theta n)/K \quad (3)$$

Next, after setting the first flag F1 to "1" in STEP 5, the controls proceed to STEP 1. In this case, since distinction of "NO" is carried out in STEP 1, the controls proceed to STEP 6 and distinction whether the rotational speed of the fan 5, i.e., the standard rotational-speed Nfn corresponding to the required combustion amount Qd at that time increases to the first threshold YNf1 or faster is carried out. In a case of Nfn<YNf1, the controls proceed to STEP 2, the regular control is carried out. On the other hand, in a case of Nfn≥YNf1, the controls proceed to STEP 7 and distinction whether the standard rotational-speed Nfn corresponding to the required combustion amount Qd is the second threshold YNf2 or slower is carried out. In a case of Nfn≤YNf2, the controls proceed to STEP 8. The opening degree Gθ of the variable throttle valve 74 is changed to an opening degree according to the above-mentioned equation (1), i.e., an increased opening degree from the high-capacity standard opening degree Gθn only to a specific degree that is calculated by multiplying a deviation from the first threshold YNf1 of the rotational speed of the fan (=Nfn) by the predetermined coefficient K and in addition, the rotational speed Nf of the fan 5 is made to the standard rotational-speed Nfn corresponding to the required combustion amount Qd.

According to the above-mentioned controls, when the rotational speed Nf of the fan 5 is increased to the first threshold YNf1 or faster and in a case where the excess air ratio λ increases beyond the appropriate value Yλ due to the reduction of the primary gas pressure, after calculation and memorization of the first threshold YNf1, when the rotational speed Nf of the fan 5 increases to the first threshold YNf1 or faster, the opening degree Gθ of the variable throttle valve 74 is immediately regulated to an opening degree which can restore the excess air ratio λ of the air-fuel mixture to the appropriate value Yλ in place of the feedback control. Accordingly, the temporal poor combustion in the case of reduction of the primary pressure can be suppressed.

Incidentally, it happens that correct values of the first and second thresholds YNf1 and YNf2 are different from those calculated and memorized values in STEP 4 due to change of the primary gas pressure. In this case, even by processing of STEP 8, the excess air ratio λ does not become the appropriate value Yλ. Therefore, after the processing of STEP 8, in STEP 9, distinction whether the excess air ratio λ of the air-fuel mixture that is detected by the excess air ratio detecting device 9 is the appropriate value Yλ is carried out. In a case of λ=Yλ, the controls go back to STEP 1 as they are. However, in a case of λ≠Yλ, the first and second flags F1 and F2 are reset to "0" in STEP 10 and the controls subsequently go back to STEP 1. According to the above-mentioned processing, the controls proceed to STEP 4 again, the first and second thresholds YNf1 and YNf2 are renewed and when the processing of STEP 8 is carried out next time, the excess air ratio λ becomes the appropriate value Yλ.

In STEP 7, when the standard rotational-speed Nfn of the fan 5 corresponding to the required combustion amount Qd at that time is distinguished to increase beyond the second threshold YNf2, the controls proceed to STEP 11, after changing the opening degree Gθ of the variable throttle valve 74 to a maximum opening degree Gθ max, distinction whether the second flag F2 is reset to "0" is carried out in STEP 12. The second flag F2 is reset to "0" in the initial state. Therefore, when the rotational speed Nf (=Nfn) of the fan 5 first increases beyond the second threshold YNf2, the controls proceed from STEP 12 to STEP 13 and the opening degree Aθ of the butterfly valve 62 is reduced from a full opening degree to an opening degree YAθ at which the excess air ratio λ of the air-fuel mixture that is detected by the excess air ratio detecting device 9 becomes the appropriate value Yλ and the opening degree YAθ is memorized.

Figure 2:
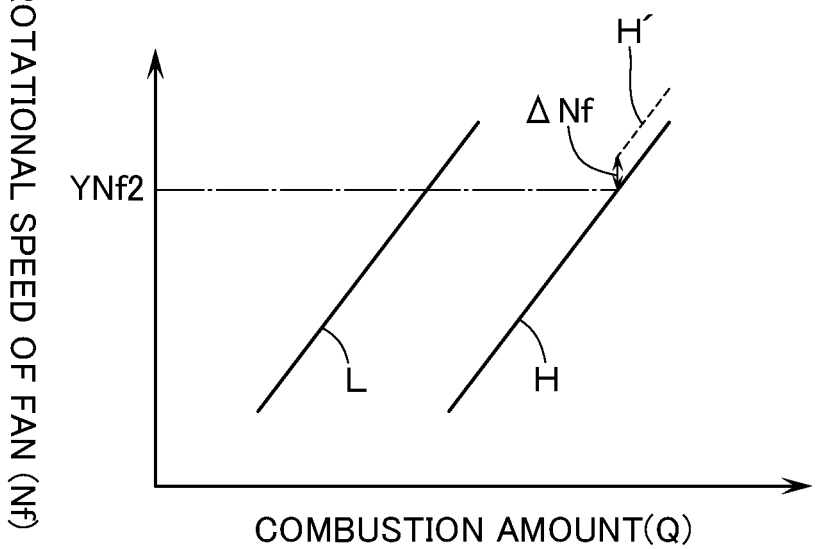
FIG. 2 is a graph showing a relationship between a rotational speed of a fan and a combustion amount in the premixing apparatus of the embodiment.

Next, the controls proceed to STEP 14, and until the combustion amount Q of the burner 1 reaches the required combustion amount Qd, that is, until a temperature of delivered hot-water rises up to a set temperature, the rotational speed NF of the fan 5 is increased beyond the standard rotational-speed Nfn corresponding to the required amount Qd, an increased amount of the rotational speed Nf of the fan 5 at this time from the standard rotational-speed Nfn (Nf−Nfn) is memorized as a rotational-speed correction value ΔNf. A line H' shown in FIG. 2 is a characteristic line that is obtained by adding the rotational-speed correction value ΔNf to the standard rotational-speed Nfn.

When processing of STEP 14 is finished, after the second flag F2 is set to "1" in STEP 15, the controls go back to STEP 1. Therefore, the standard rotational-speed Nfn of the fan 5, which corresponds to the required combustion amount Qd at that time, increases beyond the second threshold YNf2 next time, and after changing the opening degree Gθ of the throttle valve 74 to the maximum opening degree Gθ max, when the controls proceed to STEP 12, "NO" is distinguished. In this case, the controls proceed to STEP 16, the opening degree Aθ of the butterfly valve 62 is changed to the opening degree YAθ and, in addition, an increase of the rotational speed Nf of the fan 5 according to the rotational-speed correction value ΔNf, specifically, an increase of the rotational speed Nf of the fan 5 to a rotational speed which is obtained by adding the rotational-speed correction value ΔNf to the standard rotational-speed Nfn corresponding to the required combustion amount Qd, is carried out.

According to the above-mentioned processing, when the rotational speed Nf of the fan 5 is made to increase beyond the second threshold YNf2 and in a case where, even if the opening degree Gθ of the throttle valve 74 is increased to the maximum opening degree, the excess air ratio λ of the air-fuel mixture does not become the appropriate value Yλ due to the reduction of the primary pressure, after memorization of the opening degree YAθ of the butterfly valve 62 and the rotational-speed correction value ΔNf, when the rotational speed Nf of the fan 5 (=Nfn) increases beyond the second threshold YNf2, the excess air ratio λ of the air-fuel mixture is immediately restored to the appropriate value Yλ and the combustion amount Q of the burner 1 can be made to the required combustion amount Qd. Accordingly, the temporary poor combustion and short combustion amount in a fast rotational-speed region of the fan 5 can be suppressed in a case of the reduction of the primary gas pressure.

Incidentally, when the processing of STEP 16 is finished, the controls proceed to STEP 9, distinction whether the excess air ratio λ of the air-fuel mixture that is detected by the excess air ratio detecting device 9 is the appropriate value Yλ is carried out. In a case of λ=Yλ, the controls go back to STEP 1 as they are. In a case of λ≠Yλ, after the first and second flags F1 and F2 are reset to "0", the controls go back to STEP 1. Therefore, in the case of λ≠Yλ, the controls proceed to STEP 12 next time, "NO" is distinguished and the controls proceed to STEPs 13 and 14, and the above-mentioned opening degree YAθ and the above-mentioned rotational-speed correction value ΔNf are renewed.

The embodiment of the invention is explained referring to the figures in the above. On the other hand, the invention is not restricted to the above-mentioned embodiment. For example, in the embodiment, the butterfly valve 62 is disposed in the portion on the upstream side of the air supply passage 6. The butterfly valve 62 is possible to be omitted. In this case, by restricting an amount of water supplied to the heat exchanger 3, it may be sufficient to suppress the increase of the required combustion amount Qd to the combustion amount corresponding to the second threshold value YNf2 or larger. According to this manner, the processing of STEP 11 and later that are shown in FIG. 4 will become unnecessary to be carried out.

EXPLANATION OF SYMBOLS

A Premixing apparatus
1 Burner
5 Fan
6 Air supply passage
61 Gas suction part
62 Butterfly valve
7 Gas supply passage
73 Zero governor
74 Variable throttle valve

8 Controller
9 Excess air ratio detecting device
Q Combustion amount of burner
Qd Required combustion amount
λ Excess air ratio of air-fuel mixture
Yλ Appropriate value
Nf Rotational speed of fan
YNf1 first threshold
YNf2 Second threshold
Nfn Standard rotational-speed of fan
ΔNf Rotational-speed correction value
Gθ Opening degree of variable throttle valve
Gθn Standard opening degree
Gθ max Maximum opening degree
Aθ Opening degree of butterfly valve
YAθ Memorized opening degree

What is claimed is:

1. A premixing apparatus that mixes a fuel gas with air and supplies an air-fuel mixture to a burner through a fan, comprising, the fan;

an air supply passage on an upstream side of the fan;

a gas supply passage having a downstream end communicating with a gas suction part that is disposed in the air supply passage;

a zero governor that is interposed in the gas supply passage, the zero governor regulating a secondary gas pressure to an atmospheric pressure;

a variable throttle valve that is interposed in a portion, on an upstream side of the zero governor, of the gas supply passage;

an excess air ratio detecting device configured to detect an excess air ratio of the air-fuel mixture, the excess air ratio detecting device comprising at least one component selected from a flame rod that is arranged to face a combustion surface of the burner and that detects the excess air ratio based on a flame current flowing in the flame rod, and a temperature sensor that senses a rear-surface temperature of the combustion surface of the burner, the temperature varying with the excess air ratio; and a controller that is configured to carry out a first control that varies a rotational speed of the fan depending on a required combustion amount and a second control that regulates an opening degree of the variable throttle valve so that the excess air ratio of the air-fuel ratio, which is detected by the excess air ratio detecting device, becomes a predetermined value corresponding to suppression of poor combustion, wherein:

the controller is configured to carry out a third control that: when the rotational speed of the fan is increased depending on the required combustion amount and in a case where the excess air ratio of the air-fuel mixture, which is detected by the excess air ratio detecting device, increases beyond the predetermined value, and the opening degree of the variable throttle valve is controlled to increase beyond a predetermined standard opening degree so that the excess air ratio becomes the predetermined value, calculates and memorizes a lower limit of the rotational speed of the fan, at which an increase of the opening degree of the variable throttle valve becomes necessary, as a first threshold; and when the rotational speed of the fan increases to the first threshold or faster next time, immediately changes the opening degree of the variable throttle valve to an increased opening degree, which is larger than the predetermined standard opening degree and is obtained by multiplying a deviation of the rotational speed of the fan from the first threshold by a predetermined coefficient.

2. The premixing apparatus as claimed in claim 1, wherein a butterfly valve is interposed in a portion, on an upstream side of the gas suction part, of the air supply passage, wherein:

the controller is configured to carry out a fourth control that: when the rotational speed of the fan depending on the required combustion amount is increased beyond a second threshold faster than the first threshold and in a case where the excess air ratio of the air-fuel mixture, which is detected by the excess air ratio detecting device, increases beyond the predetermined value and even by increasing the opening degree of the variable throttle valve to a maximum opening degree, the excess air ratio does not become the predetermined value, reduces an opening degree of the butterfly valve to a reduced opening degree at which the excess air ratio becomes the predetermined value; memorizes the reduced opening degree; increases the rotational speed of the fan faster than a standard rotational-speed corresponding to the required combustion amount until the combustion amount of the burner reaches the required combustion amount in a state where the opening degree of the throttle valve is a maximum opening degree; memorizes an increased amount at this time of the rotational speed of the fan from the standard rotational-speed as a rotational-speed correction value; when the rotational speed of the fan is increased beyond the second threshold next time, immediately not only changes the opening degree of the variable throttle valve to the maximum opening degree but also changes the opening degree of the butterfly valve to the reduced opening degree; and increases the rotational speed of the fan according to the rotational-speed correction value.

* * * * *